United States Patent [19]

Gross et al.

[11] Patent Number: 4,626,049

[45] Date of Patent: Dec. 2, 1986

[54] CABINET UNIT WITH BUILT-IN REFRIGERATOR OR THE LIKE

[75] Inventors: Jürgen Gross, Enger; Günter Sundermeier, Bünde, both of Fed. Rep. of Germany

[73] Assignee: Paul Hettich GmbH & Co., Kirchlengern, Fed. Rep. of Germany

[21] Appl. No.: 747,934

[22] Filed: Jun. 20, 1985

[30] Foreign Application Priority Data

Jun. 28, 1984 [DE] Fed. Rep. of Germany ... 8419396[U]

[51] Int. Cl.[4] ..... A47B 97/00

[52] U.S. Cl. ..... 312/291; 16/238; 16/240; 312/292

[58] Field of Search ..... 16/238, 240; 312/291, 312/292, 326

[56] References Cited

U.S. PATENT DOCUMENTS 181,568 8/1826 Felter ..... 312/291

FOREIGN PATENT DOCUMENTS 2904397 8/1980 Fed. Rep. of Germany ..... 16/240

*Primary Examiner*—William E. Lyddane
*Assistant Examiner*—Joseph Falk
*Attorney, Agent, or Firm*—Michael J. Striker

[57] ABSTRACT

A cabinet unit has an outer door pivotable relative to an outer portion of a furniture piece to define an outer cabinet, and an inner door pivotable relative to an inner portion of a furniture piece to define an inner cabinet, such as a refrigerator and the like, wherein in an open position of the inner door a gap is available between the inner door and the inner portion of the furniture piece to provide an access to mounting and adjusting screws of a hinge of the outer door.

4 Claims, 6 Drawing Figures

CABINET UNIT WITH BUILT-IN REFRIGERATOR OR THE LIKE

BACKGROUND OF THE INVENTION

The present invention relates to a cabinet unit with a built-in refrigerator or the like.

Cabinet units of the above mentioned general type are known in the art. A known cabinet unit has an outer door which is pivotally mounted on a furniture piece by means of a hinge so as to form an outer cabinet, and an inner door pivotally mounted on another portion of the furniture piece to form an inner cabinet, such as a refrigerator or the like, in the interior of the outer cabinet. The pivot axis of the inner door of the inner cabinet lies in the vicinity of the pivot axis of the outer door, the hinge of the outer door has a mounting plate which is mounted by mounting screws on the inner side of the furniture piece, and also a hinge arm which is fixed on and adjustable relative the mounting plate by means of an adjusting screw.

In the known cabinet units of this type it was difficult to fix the hinge of the outer door on the furniture piece and to adjust the hinge arm for orienting the outer door relative to the furniture piece. The hinge arm and the mounting plate of the hinge of the known cabinet units were formed so that after insertion of these parts into the space between the built-in refrigerator or another cabinet-shaped device and the lateral wall of the outer cabinet, an easy accessibility to the mounting screws and/or the adjusting screws was no longer provided.

SUMMARY OF THE INVENTION

Accordingly, it is an object of the present invention to provide a cabinet unit which avoids the disadvantages of the prior art.

More particularly, it is an object of the present invention to provide a cabinet unit which is designed so that with a built-in refrigerator or the like, fixation of a mounting plate on the inner side of a wall of an outer cabinet and actuation of an adjusting screw for adjusting a hinge arm relative to the mounting plate of the hinge do not pose any difficulties.

In keeping with these objects and with others which will become apparent herein after, one feature of the present invention resides, briefly stated, in a cabinet unit in which a gap is formed between the inner door and the inner portion of a furniture piece in an open condition of the inner door, so as to provide an access to mounting screws of the mounting plate and/or an adjusting screw of the hinge arm of the hinge.

In this construction when the inner door is turned to its open position, the gap can be used as a mounting opening through which a shaft of a screwdriver can be inserted so as to tighten the mounting screws of the mounting plate or to actuate the adjusting screw.

In accordance with another advantageous feature of the present invention, the longitudinal axes of the mounting screws of the mounting plate and the longitudinal axis of the adjusting screw lie in one plane or approximately in one plane.

In still another advantageous feature of the present invention, the hinge arm is mounted pivotally relative to the mounting plate about an axis which extends transversely to its longitudinal axis, and a pivot bearing lies between the adjusting screw and the axis of the hinge.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
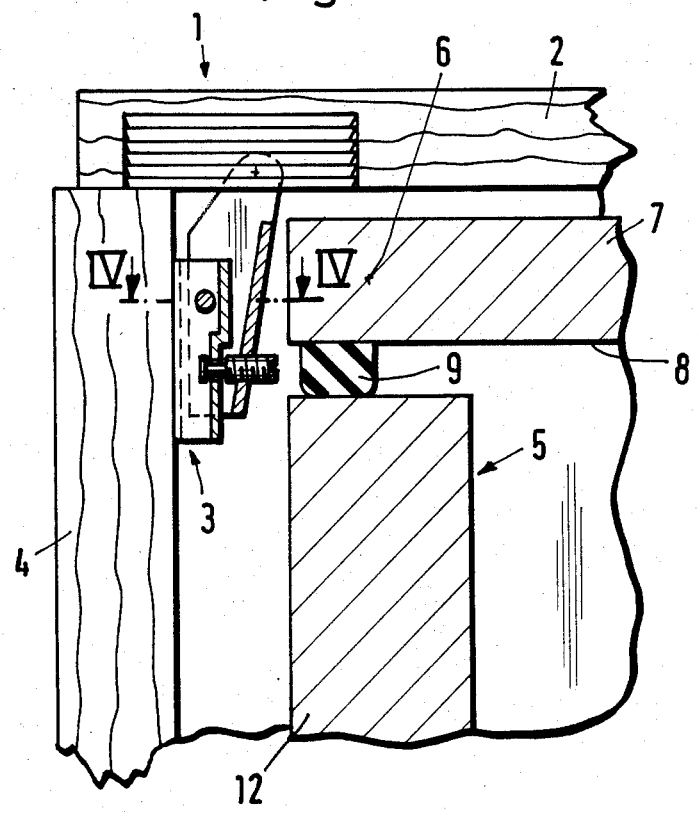
FIG. 1 is a view showing a cabinet unit with a built-in refrigerator in a horizontal section, with closed outer and inner doors.

A cabinet in accordance with the present invention is identified as a whole with reference numeral 1 and has an outer door 2 which is pivotally connected with a body 4 of a furniture piece by means of a hinge 3.

A refrigerator 5 is arranged in the interior of the cabinet. The refrigerator has an inner door 7 which is mounted turnably about an axis 6. A sealing shaped member 9 is provided at a rear side of the inner door 7 near the axis 6. In a closed position of the inner door 7 of the refrigerator 5, which is shown in FIG. 1, the sealing shaped member 9 closes a gap between the inner door 7 and an end surface 11 of another body 12 of a furniture piece.

The hinge 3 has a housing 17 which is anchored in a blind hole of the outer door 2 and connected via a link 18, 19 with a hinge arm 20. The hinge arm 20 has a U-shaped cross-section in the shown embodiment and is supported on the mounting plate 15 turnably about a pivot axis which extends transverse to the longitudinal axis of the hinge arm. The pivot axis of the hinge arm 20 is formed by a pin 21 which is fixed with its ends in lateral walls 22 of the hinge arm and turnably supported in openings of the mounting plate 15.

The adjustment of the hinge arm relative to the mounting plate 15 is performed by an adjusting screw 16 which is turnably supported with its foot in a cutout 23 of the mounting plate, but is not displaceable along its longitudinal axis. The adjusting screw 16 is screwed in a threaded opening of the hinge arm. Mounting screws 14 connect the mounting plate 15 with the body 4 of the furniture piece. The longitudinal axes of the mounting screws 14 of the mounting plate 15 and the longitudinal axis of the adjusting screw 16 lie approximately in one plane in the shown embodiment. It is believed to be understood that they can lie exactly in the same plane.

Figure 2:
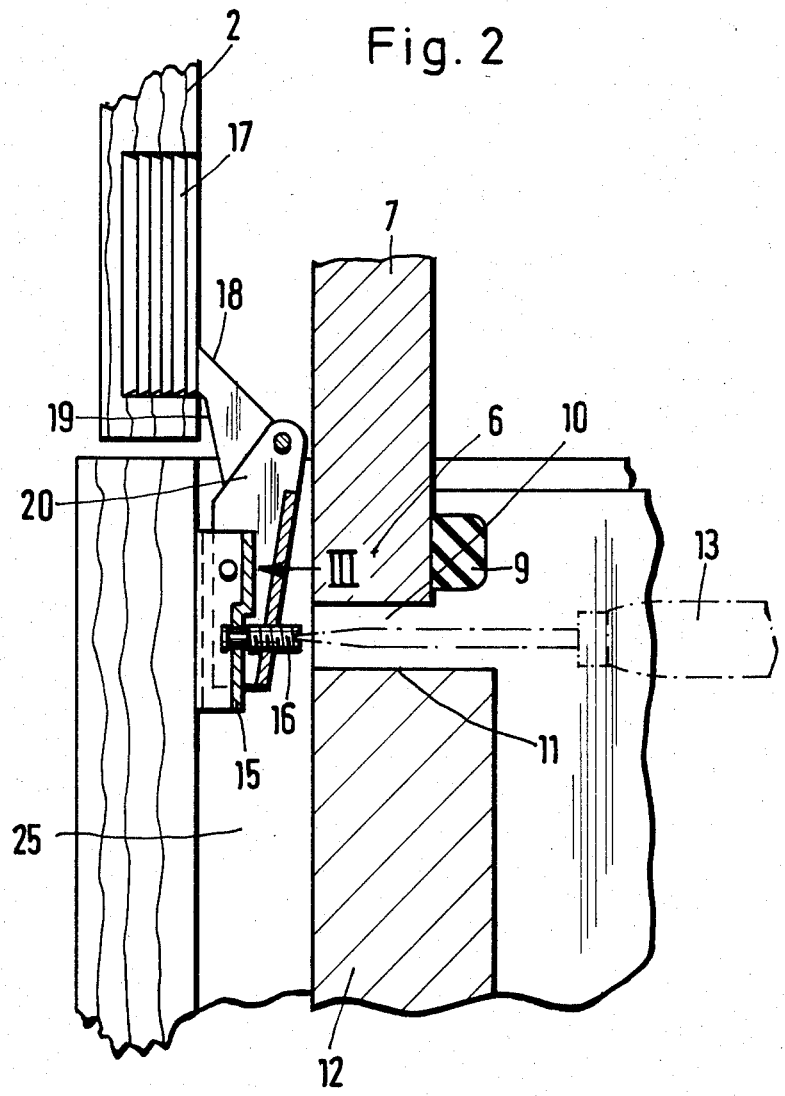
FIG. 2 is a view showing the cabinet unit of FIG. 1 with opened outer and inner doors.
Figure 3:
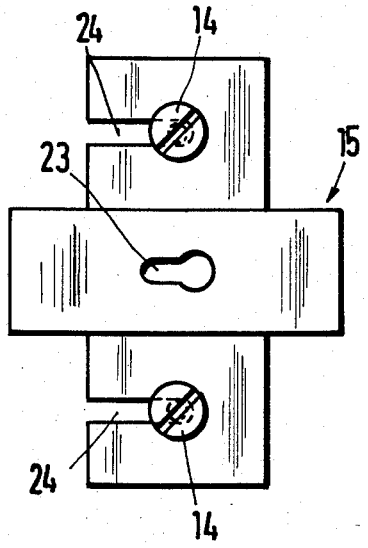
FIG. 3 is a view showing a mounting plate of a hinge of the cabinet unit of FIGS. 1 and 2, as seen in direction of the arrow III in FIG. 2.
Figure 4:
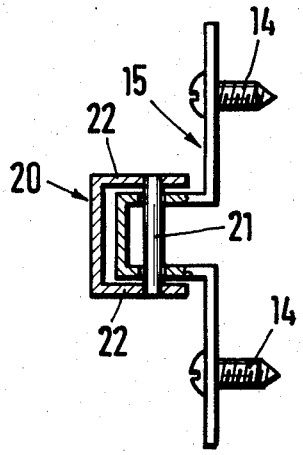
FIG. 4 is a view showing a section taken along the line IV—IV in FIG. 1.

In an open position of the inner door 7 of the refrigerator 5, which is shown in FIG. 2, an opening gap 10 is formed between the end surface 11 of the body 12 of the furniture piece and the inner door 7. This gap can be used for passing an actuating tool 13 for the mounting screws 14 of the mounting plate 5 and/or for the adjusting screw 16.

For simple mounting of the mounting plate 15 with the hinge arm 20 connected therewith and particularly from the open side of the cabinet, the mounting plate 15 is provided at its side which facing away of the axis of the hinge 3 with insertion slots 24 for the mounting screws 14. With the inner door 7 in the opening position, the mounting plate 15 with the hinge arm 20 is inserted into a space 25. Then first the mounting screws 14 are partially screwed into the body 4 of the furniture piece of the outer cabinet. The insertion slots 24 allow the displacement of the mounting plate onto the mounting screws 14, and the latter are tightened through the opening gap 10 by means of the actuating tool 13.

Figure 5:
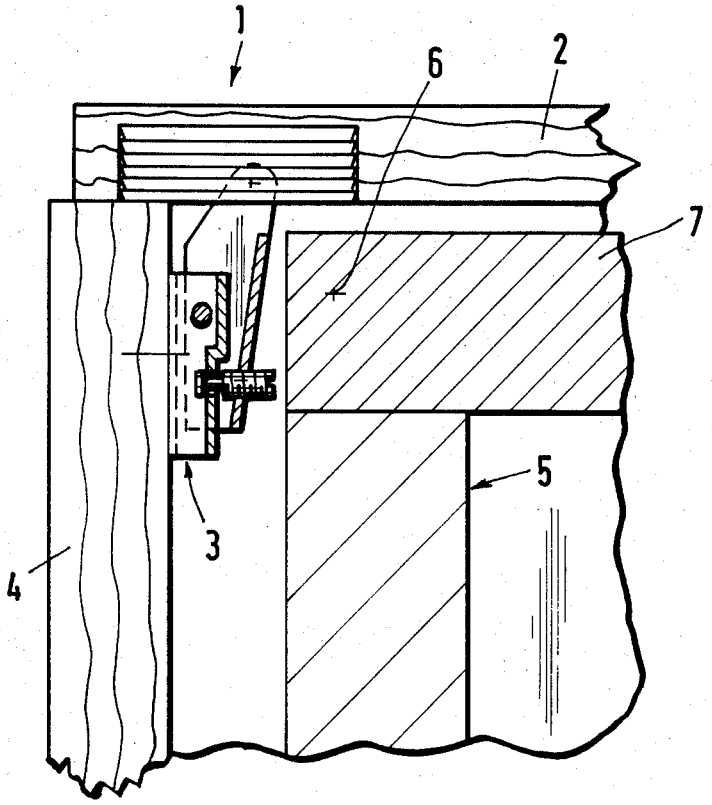
FIG. 5 is a view showing a cabinet unit with a built-in refrigerator in accordance with another embodiment of the invention.
Figure 6:
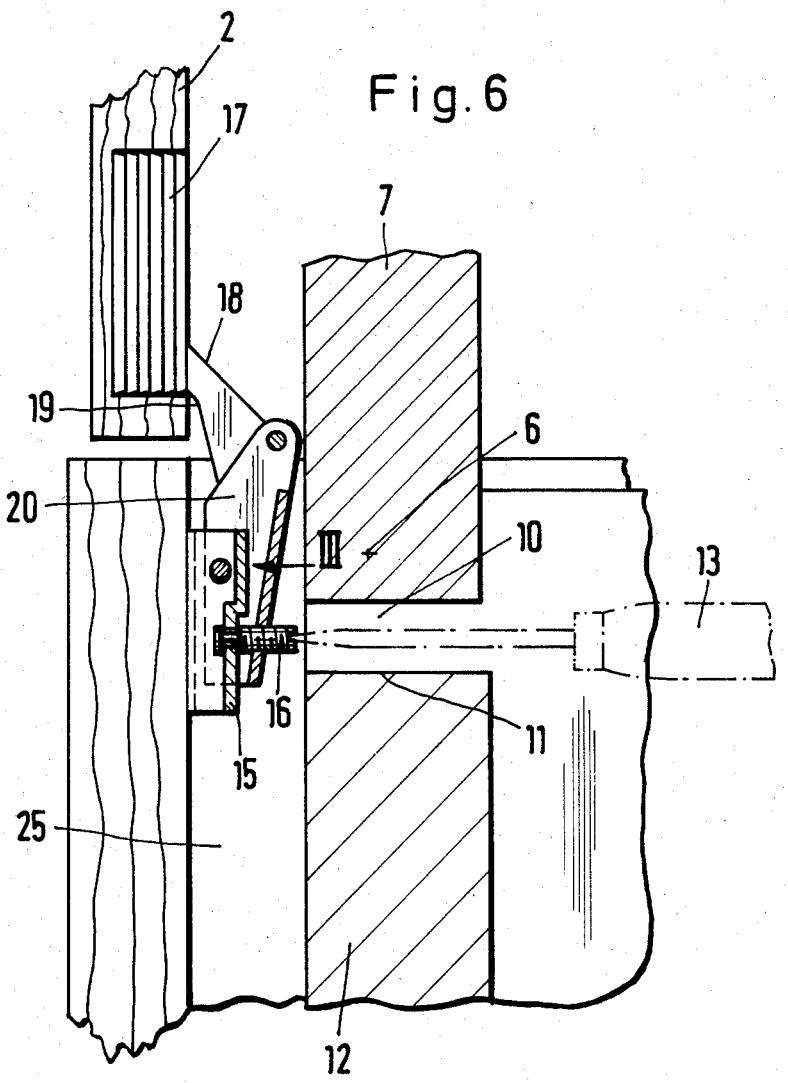
FIG. 6 is a view showing the cabinet unit of FIG. 5 with opened outer and inner doors.

In accordance with another embodiment of the present invention shown in FIGS. 5 and 6, in the closed position of the inner door 7 its inner limiting surface abuts against the end surface 11 of the inner body 12 of the furniture piece. In the open position which is shown in FIG. 6, the opening gap is available between the inner door 7 and the end surface 11 of the furniture piece body 12, and it can be used as shown in FIG. 6 as a mounting opening.

It will be understood that each of the elements described above, or two or more together, may also find a useful application in other types of constructions differing from the types described above.

While the invention has been illustrated and described as embodied in a cabinet with a refrigerator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A cabinet unit, comprising an outer cabinet including an outer portion of a furniture piece; an outer door pivotally mounted on said outer portion for turning about a first axis, means for pivotally mounting said outer door on said outer portion and including a hinge having a mounting plate mounted on said outer portion and a hinge arm connected with said outer door and fixed on and adjustable relative to said mounting plate, screw means for mounting and adjusting said hinge and including mounting screws which mount said mounting plate on said outer portion and an adjusting screw which adjusts said hinge arm relative to said mounting plate; and an inner cabinet including an inner portion of a piece of furniture, an inner door mounted pivotally relative to said inner portion about a second axis which is located substantially close to said first axis, said inner door being movable between a closed position in which it closes an interior of said inner cabinet and an open position in which it opens the interior of said inner cabinet so that in said open position a gap is formed between said second portion of a furniture piece and said inner door to allow access to said mounting screws and said adjusting screw, while in said closed position said inner door blocks access to said mounting screws and said adjusting screw.

2. A cabinet unit as defined in claim 1; and further comprising a pin which forms a pivot bearing between said hinge arm and said mounting plate, said pivot bearing being arranged between said adjusting screw and said first axis.

3. A cabinet unit as defined in claim 1, wherein said mounting screws have longitudinal axes, said adjusting screw having a longitudinal axis, said longitudinal axes of said mounting screws and said longitudinal axis of said adjusting screw lying in one plane.

4. A cabinet unit as defined in claim 1, wherein said mounting plate has a side which faces away of said first axis and is provided at said side with insertion slots for said mounting screws.

* * * * *